US008688022B2

(12) United States Patent
Sudo et al.

(10) Patent No.: US 8,688,022 B2
(45) Date of Patent: Apr. 1, 2014

(54) HEAT FIXING BELT WITH METAL MESH ELECTRODES, A FIXING DEVICE USING THE BELT AND A METHOD FOR MAKING THE BELT

(75) Inventors: Susumu Sudo, Tokyo (JP); Tetsuo Sano, Tokyo (JP); Eiichi Yoshida, Tokyo (JP); Izumi Mukoyama, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 32 days.

(21) Appl. No.: 13/476,738

(22) Filed: May 21, 2012

(65) Prior Publication Data

US 2012/0301194 A1 Nov. 29, 2012

(30) Foreign Application Priority Data

May 25, 2011 (JP) ..... 2011-116524

(51) Int. Cl.
*G03G 15/20* (2006.01)

(52) U.S. Cl.
USPC ..... 399/329

(58) Field of Classification Search
USPC ..... 399/329, 88, 90, 333
See application file for complete search history.

(56) References Cited

U.S. PATENT DOCUMENTS

2009/0169231 A1 * 7/2009 Asakura et al. ..... 399/69

FOREIGN PATENT DOCUMENTS

| | | | |
|---|---|---|---|
| JP | 10-142972 | | 5/1998 |
| JP | 2000-066539 | | 3/2000 |
| JP | 2004-281123 | | 10/2004 |
| JP | 2006343538 | A * | 12/2006 |
| JP | 2009-092785 | | 4/2009 |
| JP | 2009092785 | A * | 4/2009 |

* cited by examiner

*Primary Examiner* — Billy Lactaoen
(74) *Attorney, Agent, or Firm* — Lucas & Mercanti, LLP

(57) ABSTRACT

Disclosed are a heating fixing belt and a fixing device by which good long-term durability is achieved, and a process for forming the heating fixing belt.
The heating fixing belt comprises a resistance heating layer formed of a resin in which at least a conductive substance is dispersed, a parting layer laminated on the resistance heating layer and a pair of electrodes for supplying electric power to the resistance heating layer, which are respectively stacked and provided on both end portions of the resistance heating layer in such a manner that at least parts thereof come into contact with the resistance heating layer, wherein the electrodes are each composed of a metal mesh sheet. In the heating fixing belt, the metal mesh sheet forming the electrode preferably has an aperture ratio of 10 to 60.

7 Claims, 3 Drawing Sheets

(a)

(b)

(a)

(b)

(a)

(b)

HEAT FIXING BELT WITH METAL MESH ELECTRODES, A FIXING DEVICE USING THE BELT AND A METHOD FOR MAKING THE BELT

CROSS REFERENCE TO RELATED APPLICATION

This Application claims the priority of Japanese Patent Application No. 2011-116524 filed on May 25, 2011, and incorporated by reference herein.

TECHNICAL FIELD

The present invention relates to a heating fixing belt for fixing a toner image formed by an image forming method of an electrophotographic system on an image-supporting medium by heat, a fixing device using this belt and a process for forming the heating fixing belt.

BACKGROUND ART

In an image forming apparatus such as a copying machine or a laser beam printer, a method of fixing an unfixed toner image by contact heating by a heated roller system has heretofore been often used as a method for fixing the unfixed toner image transferred to an image-supporting medium such as plain paper after development with a toner.

However, the fixing device of the heated, roller system; involves a problem that it takes a long time to neat a roller to a finable temperature, and a lot of thermal energy is required, and so a fixing system by a heated film, has been mainly adopted in recent years from the viewpoints of shortening of a time (warming-up time) from turning on the power to a start in copying and energy saving.

In a fixing device of this fixing system by the heated film, a seamless fixing belt obtained by laminating a parting layer formed of a fluorocarbonresin or the like on an external surface of a heat-resistant film formed of polyimide or the like is used.

In the fixing device of such a fixing system by the heated film, the heat-resistant film is heated by, for example, a ceramic heater, and a toner image is fixed by the surface of the heat-resistant film, so that the thermal conductivity of the heat-resistant film is important. However, when the thickness of the neat-resistant film has been thinned, to improve the thermal conductivity thereof, it has been difficult to adopt it in a medium-speed or high-speed machine, because the mechanical strength thereof is lowered and so the belt is difficult to be rotationally moved, and there has been a problem that the ceramic heater or the like is liable to be broken.

In order to solve such a problem, in recent years, there has been proposed a fixing device of a system that a resistance heating layer having a heating element is incorporated into a fixing belt itself, and the fixing belt is directly heated by supplying electric power to this resistance heating layer to fix a toner image (see, for example. Patent Literatures 1 to 4). It may be said that an image forming apparatus in which the fixing device of this system is installed is short in warming-up time, smaller in electric energy consumption than that of fixing system by the heated film, and excellent from the viewpoints of energy saving and high-speed printing.

The fixing belt (heating fixing belt) provided with this resistance heating layer includes a belt that a metallic electrode is embedded in a conductive paste for forming a resistance heating layer and a belt that a metallic tape is stuck on a conductive layer. However, both belts involve a problem that long-term durability is lacking.

CITATION LIST

Patent Literature

Patent Literature 1: Japanese Patent Application Laid-Open No. 2000-066539

Patent Literature 2; Japanese Patent Application Laid-Open No. 2004-281123

Patent Literature 3: Japanese Patent Application Laid-Open No. 10-142972

Patent Literature 4: Japanese Patent Application Laid-Open No. 2009-092785

SUMMARY OF INVENTION

Technical Problem

The present invention has been, made in view of the foregoing circumstances and has its object the provision of a heating fixing belt and a fixing device by which good long-terra durability is achieved, and a process for forming the heating fixing belt.

Solution to Problem

According to the present invention, there is provided a heating fixing belt comprising a resistance heating layer formed of a resin in which at least a conductive substance is dispersed, a parting layer laminated on the resistance heating layer and a pair of electrodes for supplying electric power to the resistance heating layer, which are respectively stacked and provided on both end portions of the resistance heating layer in such a manner that at least parts thereof come into contact with the resistance heating layer, wherein the electrodes are each composed of a metal mesh sheet.

In the heating fixing belt according to the present invention, the metal mesh sheet forming the electrode may preferably have an aperture ratio of 10 to 60.

In the heating fixing belt according to the present invention, the resin forming the resistance heating layer may preferably be a polymide resin.

In the heating fixing belt, according to the present invention, the heating fixing belt may preferably further comprise an elastic layer laminated thereon.

In the heating fixing belt according to the present invention, the size or the electrode may preferably be 5 to 30 area % to the area of the resistance heating layer.

In the heating fixing belt according to the present invention, the thickness of the electrode may preferably be 10 to 100 μm.

According to the present invention, there is also provided a fixing device comprising the heating fixing belt described above.

According to the present invention, there is further provided a process for forming the heating fixing belt described above, which comprises placing a metal mesh sheet forming an electrode on an endless belt-like body formed from polyamic acid in a state brought into surface contact with the belt-like body, and baking both the endless belt-like body and the metal mesh sheet, to imidate the polyamic acid, thereby forming a polyimide resin to form a resistance heating layer while bonding the electrode to the resistance heating layer.

Advantageous Effects of Invention

According to the heating fixing belt of the present invention, the electrode is fundamentally excellent in durability because it is made of a metal, firm adhesion is achieved between the metal mesh, sheet and the resistance heating layer by an anchor effect because the electrode is composed of the metal mesh sheet, and consequently good long-term durability is achieved, so that desired heating performance can be exhibited over a long period of time.

According to the heating fixing belt in which the resin forming the resistance heating layer is the polyimide resin, both the polyamic acid forming the polyimide resin and the metal mesh sheet are baked in a state that they have been brought into surface contact with each other, whereby evaporation of a solvent related to the polyamic acid and water formed with the imidation is not inhibited, so that a desired polyimide resin can be easily formed, and the electrode can be formed at the same time as the step of forming the polyimide resin. Accordingly, the production process can be simplified, and a state that a mesh portion in the metal mesh sheet that is the electrode has been impregnated with the polyimide resin is formed, so that firm adhesion between the metal mesh sheet and the resistance heating layer is easily achieved.

DESCRIPTION OF EMBODIMENTS

The present invention will hereinafter be described specifically.

Figure 1:
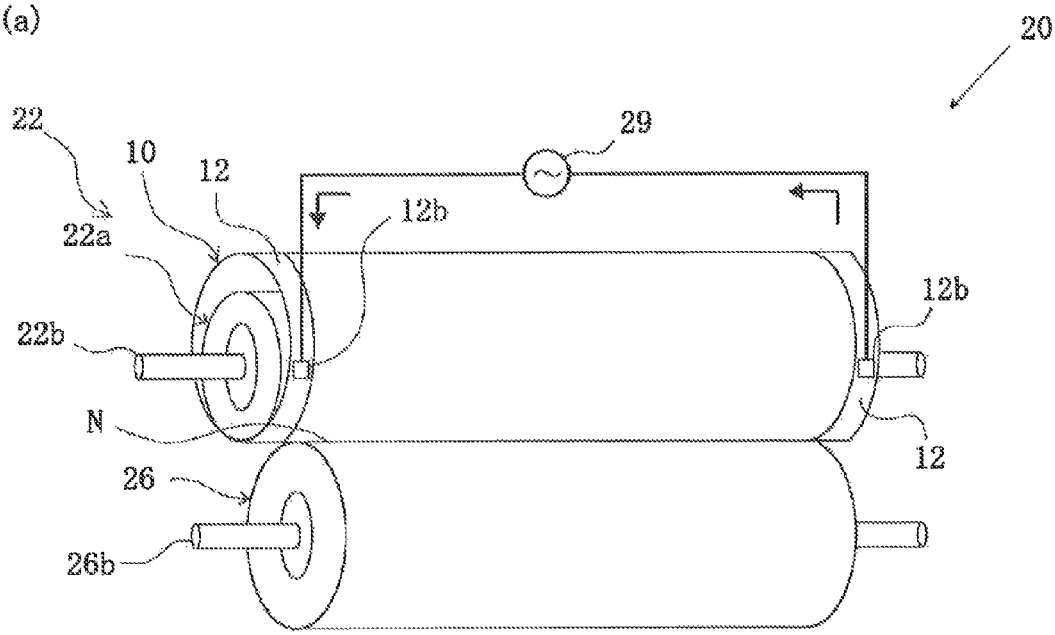
FIG. 1 typically illustrates the construction of an exemplary fixing device according to the present invention, in which FIG. 1(*a*) is a perspective view, and FIG. 1(*b*) is a cross-sectional view.
Figure 1:
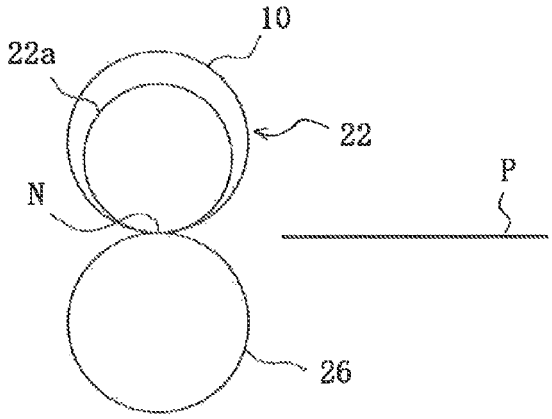

Fixing Device:

The fixing device according to the present invention is obtained by bringing one fixing rotator 22 coming into contact with a surface of an image-supporting medium P, on which a toner image has been formed, and a pressure roller 26 that is the another fixing rotator into contact under pressure with each other as illustrated in FIG. 1, and a nip portion N is formed by contacting portions of these fixing rotators 22 and 26.

Said one fixing rotator 22 coming into contact with the surface of the image-supporting medium P, on which the toner image has been formed, has the endless heating fixing belt 10 according to the present invention, and a nip portion-forming roller 22*a* is provided inside this heating fixing belt 10 in a state that the roller 22*a* and the pressure roller 26 are brought into contact under pressure with each other through the heating fixing belt 10.

In FIG. 1, reference signs 22*b* and 26*b* designate a shaft of the nip portion-forming roller 22*a* and a shaft of the pressure roller 26, respectively.

The fixing device 20 according to this embodiment is so constructed that the axial length of the pressure roller 26 is shorter than the nip portion-forming roller 22*a*, and the axial length of the heating fixing belt 10 is substantially the same as the axial length of the nip portion-forming roller 22*a*, and so only a central portion of the heating fixing belt 10 comes into contact with the pressure roller 26 to bring them into contact, under pressure with each other. A pair of electrodes 12, 12 are respectively provided on both end portions of the heating fixing belt 10, with which the pressure roller 26 does not come into contact, and these electrodes 12 are connected to a high-frequency power source 29 through respective power supply members 12*b*.

In this fixing device 20, the image-supporting medium P, on one surface of which the toner image has been formed, is conveyed while being sandwiched under pressure in the nip portion N, whereby the toner image is fixed on the image-supporting medium P.

Figure 2:
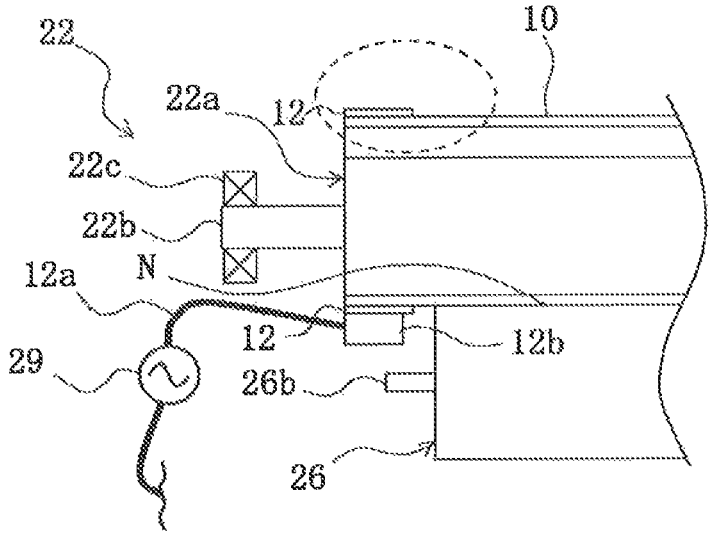
FIG. 2(*a*) is a longitudinal sectional view illustrating the construction of the exemplary fixing device shown in FIG. 1, and FIG. 2(*b*) is an expanded view of a region surrounded by a dotted line in FIG. 2(*a*).
Figure 2:
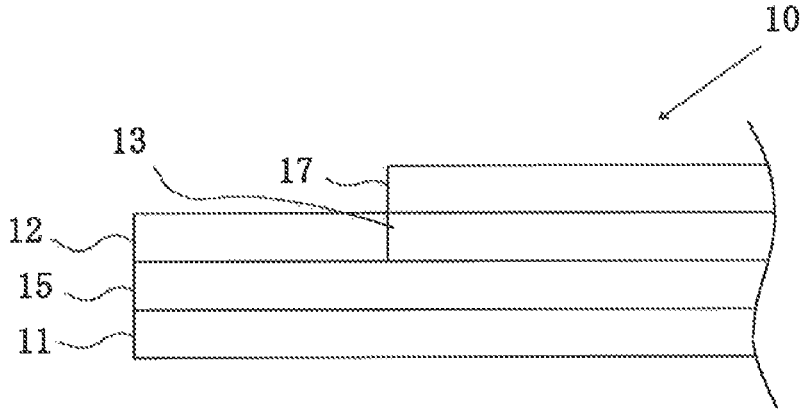

Heating Fixing Belt:

The heating fixing belt according to the present invention is obtained by laminating a resistance heating layer 15 formed of a resin in which at least a conductive substance is dispersed, an elastic layer 13 and a parting layer 17 on one another and providing a pair of electrodes 12 for supplying electric power to the resistance heating layer 15 as illustrated in FIG. 2(*b*), and features that the electrodes 12 are each composed of a metal mesh sheet.

Specifically, the elastic layer 13 is formed on the surface of the endless resistance heating layer 15, the parting layer 17 is further formed on the surface of this elastic layer 13, the electrodes 12 are bonded to respective regions on the surface of the resistance heating layer 15, on which the elastic layer 13 is not formed, in a state brought into surface contact with the resistance heating layer 15, and a reinforcing layer 11 is provided on a back surface of the resistance heating layer 15.

The reinforcing layer 11 is provided as needed, and any other functional layer may also be provided in the heating fixing belt 10 according to the present invention as needed.

In FIG. 2(*a*), reference signs 22*c* and 12*a* designate a drive gear for rotating the nip portion-forming roller 22*a* and a lead wire, respectively.

Resistance Heating Layer:

Conductive Substance

Examples of a material of the conductive substance dispersed, in the resistance beaming layer 15 include pure metals such as gold, silver, iron and aluminum, alloys such as stainless steel and nichrome, and nonmetals such as carbon and graphite, and the conductive substance is in the form of spherical powder, formless powder, flake powder, fiber or the like.

The conductive substance dispersed in the resistance heating layer 15 of the heating fixing belt 10 according to the present invention is preferably fibrous graphite from the viewpoint of heat-generating ability.

Here, the term "fibrous" means that a length (L) is at least 4 times as much as a breadth (l).

As a production process of such fibrous graphite, may be adopted a publicly known production process. That is, graphite formed into fiber by drawing from a nozzle is, stretched while being heated as needed, if required, and then roasted at a temperature of 200 to 300° C. to carbonize it, thereby forming yarn strong against flames, the yarn is then roasted at a high temperature of 1,000 to 3,000° C. Other impurities than carbon contained in the yarn are removed by going through such a process to obtain a very strong skeleton (molecular structure) of carbon. The intended fibrous graphite can be produced by first obtaining the yarn having the breadth (l) of the desired conductive substance by going through such a process and then cutting the yarn into a predetermined length (length (L)).

The volume specific resistivity of the conductive material is preferably $1\times10^{-1}\Omega\cdot m$ or less.

When the conductive substance is fibrous, the volume specific resistivity of such a conductive substance is calculated out according to the following equation (1) by causing a fixed current I (A) to flow in the conductive substance to measure a potential difference V (V) between electrodes distant by a distance L.

$$\text{Volume specific resistivity } \rho v=(V\cdot Wt)/IL \qquad \text{Equation (1)}$$

wherein Wt is a sectional area of the conductive substance.

The length (L) of the fibrous conductive substance is preferably 2 to 1,000 μm, and the breadth (l) thereof is preferably 0.5 to 250 μm.

If the breadth is less than 0.5 μm, contact resistance when fibers of the conductive substance dispersed in the resistance heating layer 15 cone into contact with each other becomes excessively high, so that a resistance value of the whole resistance heating layer 15 may not be sufficiently lowered in some cases. If the breadth exceeds 250 μm on the other hand, the dispersibility of the conductive substance in the resistance heating layer 15 becomes low, so that there is a possibility that local scattering may occur in electrical resistance. If the length is less than 2 μm, it is hard to form, a charge conducting path. If the length exceeds 1,000 μm, such a conductive substance cannot be always caused to exist in the resistance heating layer 15 in the form sufficiently elongated, so that there is a possibility that local scattering may occur in the electrical resistance of the resistance heating layer.

In the above, the length (L) and breadth (l) of the fibrous conductive substance are average values calculated out by taking a photograph enlarged to 500 magnifications through a scanning electron microscope and measuring respective lengths and breadths on optional 500 samples from an image obtained by taking this photograph in a scanner.

The content of the conductive substance in the resistance heating layer 15 is 5 to 60% by mass.

Resin:

The resin forming the resistance heating layer 15 of the heating fixing belt 10 according to the present invention is what is called a heat-resistant resin. The heat-resistant resin means a resin whose short-term heat resistance is at least 200° C. and whose long-term heat resistance is at least 150° C.

Examples of such a heat-resistant resin include poly(phenylene sulfide) (PPS), polyarylate (PAR), polysulfone (PSF), poly(ether sulfone) (PES), poly(ether imide) (PEI), polyimide (PI), polyamide-imide (PAI), poly (ether ether ketone) (PEEK) resins. The resin forming the resistance heating layer 15 of the heating fixing belt 10 according to the present invention is particularly preferably a polyimide resin.

According to the heat fixing belt in which the resin forming the resistance heating layer 15 is the polyimide resin, both the polyamic acid forming the polyimide resin and a metal mesh sheet are baked in a state that they have been brought into surface contact with each other, whereby evaporation of a solvent related to the polyamic acid and water formed with the imidation is not inhibited, so that a desired polyimide resin can be easily formed, and an electrode can be formed at the same time as the step of forming the polyimide resin. Accordingly, the production process can be simplified, and a state that a mesh portion in the metal mesh sheet that is the electrode has been impregnated with the polyimide resin is formed, so that, firm adhesion between this metal mesh sheet and the resistance heating layer 15 is easily achieved.

In the resistance heating layer 15, at least 40% by volume of the whole resin forming this layer is extremely preferably the heat-resistant resin.

The thickness of the resistance heating layer 15 is preferably 10 to 300 μm, more preferably 30 to 200 μm.

The volume resistivity of the resistance heating layer 15 is preferably $8\times10^{-6}$ to $1\times10^{-2}\Omega\cdot$m.

The volume resistivity of the resistance heating layer 15 is calculated out according to the following equation (2) by providing electrodes composed of a conductive tape on both end portions in a circumferential direction of the whole circumference of the heating fixing belt 10 to measure a resistance value between both ends.

$$\text{Volume resistivity } \rho=(R\cdot d\cdot W)/L \qquad \text{Equation (2)}$$

wherein R is a resistance value (Ω), d is a thickness (m) of the resistance heating layer 15, W is a length (m) in a circumferential direction of the heating fixing belt 10, and L is a length (m) between the electrodes.

Electrode:

The electrode 12 provided in the heating fixing belt 10 according to the present invention is composed of a metal mesh sheet.

Examples of the metal forming the metal mesh sheet which becomes this electrode 12 include Ni, stainless steel, Al, silver and iron, and stainless steel or Ni is preferably used in that an electrical resistivity is low, and heat resistance and oxidation resistance are high, with stainless steel being particularly preferred.

The term "mesh" used in the present invention means a form having any of meshes in a woven, fabric, stitches in a knitted fabric and fine openings punched at even intervals.

This metal mesh, sheet which become this electrode 12 preferably has an aperture ratio of 10 to 60.

The aperture ratio of the metal mesh sheet falls within the above range, whereby firm adhesion is achieved between the electrode 12 and the resistance heating layer 15 by an anchor effect, and consequently the resulting heating fixing belt 10 comes to surely have good long-term durability. On the other hand, if the aperture ratio of the metal mesh sheet is too low, the resin forming the resistance heating layer is not sufficiently impregnated into a mesh portion in the metal mesh sheet which becomes the electrode upon the adhesion between the electrode and the resistance heating layer, so that satisfactory adhesion cannot be achieved, and there is thus a possibility that sufficient long-term, durability may not be achieved in the resulting heating fixing belt. If the aperture ratio of the metal mesh sheet is too high, a sufficient anchor effect is not achieved between the electrode 12 and the resistance heating layer 15, so that satisfactory adhesion cannot be achieved, and there is thus a possibility that sufficient long-term durability may not be achieved in the resulting heating fixing belt.

The aperture ratio of the metal mesh sheet is a proportion of an area of the openings to an area of the sheet and is calculated out according to the following equation (3).

$$\text{Aperture ratio}=(\text{Projected area of openings in the metal mesh sheet})/[(\text{Projected area of openings in the metal mesh sheet})+(\text{Projected area of metal portions in the metal mesh sheet})]. \qquad \text{Equation (3)}$$

In the above equation (3), the projected area of metal portions in the metal mesh sheet means an area of shade portions in a projected image obtained by projecting the metal mesh sheet on a plane parallel to the metal mesh sheet, and the projected area of openings in the metal mesh sheet means an area of openings in the metal mesh sheet in the projected image.

The size of the electrode 12 described above is 5 to 30 area % to the area of the resistance heating layer 15 though it varies according to the desired heating temperature of the heating fixing belt 10.

The thickness of the electrode 12 is preferably 10 to 100 μm, more preferably 30 to 60 μm.

The power supply to the resistance heating layer 15 is made, for example, from the high-frequency power source 29 through the power supply member 12*b* and the electrode 12 via a wire bundle or harness.

The power supply from the power supply member 12*b* to the electrode 12 is made by, for example, bringing the power supply member 12*b* into contact with the electrode 12 alone. Examples of a specific contact method include a sliding contact method and a rotational contact method using a roller or the like.

A contact load between the power supply member 12*b* and the electrode 12 may be optional so far as electrical connection is ensured, and the load thereof does not become excessive stress upon the drive of the heating fixing belt 10.

As the power supply member 12*b*, may be used, for example, a metal brush composed of stainless steep (SUS), Cu, brass, Zn, Ni or the like or a carbon brush, and the carbon brush is particularly preferably used.

Elastic Layer:

The elastic layer 13 making up the heating fixing belt 10 according to the present invention is formed of, for example, a heat-resistant resin having elasticity.

Examples of the heat-resistant resin having elasticity include silicone rubber, natural rubber (NR), butadiene rubber (BR), acrylonitrile-butadiene rubber (NBR), hydrogenated NBR (H-NBR), styrene-butadiene rubber (SBR), isoprene rubber (IR), urethane rubber, chloroprene rubber (CR), chlorinated, polyethylene (Cl-PE), epihalohydrin rubber (ECO, CO), butyl rubber (IIR), ethylene-propylene-diene polymers (EPDM), fluorine-containing rubber and acrylic rubber (ACM). Among these, CR, ECO, silicone rubber, butyl-rubber, acrylic rubber and urethane rubber are preferably used.

The thickness of the elastic layer 13 is preferably 50 to 300 μm, more preferably 100 to 200 μm.

Parting Layer:

The parting layer 17 making up the heating fixing belt 10 according to the present invention is formed of polytetrafluoroethylene (PIPE), tetrafluoroethylene-perfluoroalkyl vinyl ether copolymer (PFA), tetrafluoroethylene-hexafluoropropylene copolymer (FEP) or the like.

The thickness of the parting layer 17 is preferably 1 to 20 μm, more preferably 2 to 10 μm.

Reinforcing Layer:

The reinforcing layer 11 making up the heating fixing belt 10 according to the present invention is provided as needed and is formed of a heat-resistant resin.

As the heat-resistant resin forming the reinforcing layer 11, may be mentioned that mentioned as the resin forming the resistance heating layer 15.

The thickness of the reinforcing layer 11 is preferably 20 to 100 μm, more preferably 30 to 80 μm.

According to the heating fixing belt 10 described above, the electrode 12 is fundamentally excellent in durability because it is made of the metal, firm adhesion is achieved between the metal mesh sheet and the resistance heating layer 15 by an anchor effect because the electrode 12 is composed of the metal mesh sheet, and consequently good long-term durability is achieved, so that desired heating performance can be exhibited over a long period of time.

Forming Process of Heating Fixing Belt:

The heating fixing belt 10 described above can be formed by using any of publicly known various processes. However, when the resin forming the resistance heating layer 15 is a polyimide resin, the resistance heating layer 15 and the electrode 12 are preferably formed in the following manner.

That is, a metal mesh sheet forming the electrode 12 is placed on an endless belt-like body formed from polyamic acid, which is a precursor of a polyimide resin for the resistance heating layer 15, in a state that they have been brought into surface contact with each other, and both of them are baked to imidate the polyamic acid, whereby a polyimide resin can be formed to form the resistance heating layer 15 while the electrode 12 can be bonded to the resistance heating layer.

Specifically, the process comprises a series of steps of:

(1) a polyamic acid dope liquid-preparing step of preparing a polyamic acid dope liquid with a conductive substance added into polyamic acid, (2) a belt-like precursor-forming step of applying the polyamic acid dope liquid on to the reinforcing layer 11 and drying the liquid to obtain a belt-like body and placing the metal mesh sheet forming the electrode 12 on this belt-like body in a state brought into surface contact with each other to obtain a belt-like precursor, and (3) an imidation reaction step of baking the belt-like precursor to form a polyimide resin.

The reinforcing layer 11, the elastic layer 13 and the parting layer 17 can be formed by respective proper processes.

(1) Polyamic Acid Dope Liquid-Preparing Step:

This polyamic acid, dope liquid-preparing step is a step of synthesizing polyamic acid by polycondensing an aromatic tetracarboxylic acid and an aromatic diamine and dispersing the conductive substance therein.

Specifically, the polycondensation is conducted in a solvent composed of a good solvent for polyamic acid to obtain a polyamic acid solution with polyamic acid dissolved therein.

The good solvent for polyamic acid means a solvent capable of uniformly dissolving the polyamic acid therein at a concentration of 20% by mass or more at 25° C. As examples of such a good solvent, may be mentioned organic polar solvents, such as amides such as N,N-dimethylacetamide, N,N-diethylacetamide, N,N-dimethyl-formamide, N,N-diethyl-formamide, N-methyl-2-pyrrolidone and hexamethylsulfonamide; sulfoxides such as dimethyl sulfoxide and diethyl sulfoxide; and sulfones such as dimethyl sulfone and diethyl sulfone. These solvents may be used either singly or in any combination thereof.

N-Methyl-2-pyrrolidone is preferably used as the solvent.

The amount of the solvent used may be optional so far as the concentration of the polyamic acid in the polyamic acid solution obtained after the polycondensation falls within a range of, for example, 2 to 50% by mass.

As a process for polycondensing the aromatic tetracarboxylic acid and the aromatic diamine, may be adopted any of publicly known various processes. Specifically, a process comprising using the aromatic tetracarboxylic acid and the aromatic diamine in almost equimolar amounts and conducting polycondensation for 0.1 to 60 hours at 100° C. or lower, preferably, in a temperature range of 0 to 80° C. in the solvent is mentioned.

Aromatic Tetracarboxylic Acid:

No particular limitation is imposed on the aromatic tetracarboxylic acid used in the synthesis of the polyamic acid. As examples thereof, may be mentioned aromatic tetracarboxylic acids, and anhydrides, salts and esterified products thereof as well as mixtures thereof, and a dianhydride of the aromatic tetracarboxylic acid is particularly preferably used.

As specific examples of the dianhydride of the aromatic tetracarboxylic acid, may be mentioned pyromellitic dianhydride (PMDA), naphthalene-1,2,5,6-tetracarboxylic dianhydride, naphthalene-1,4,5,8-tetracarboxylic dianhydride, naphthalene-2,3,6,7-tetracarboxylic dianhydride, biphenyl-2,2',3,3'-tetracarboxylic dianhydride, biphenyl-3,3',4,4'-tetracarboxylic dianhydride (BPDA), benzophenone-2,2',3,3'-tetracarboxylic dianhydride, benzophenone-2,3,3',4'-tetracarboxylic dianhydride, benzophenone-3,3',4,4'-tetracarboxylic dianhydride (BTDA), bis(3,4-dicarboxyphenyl)sulfone dianhydride, bis(2,3-dicarboxyphenyl)methane dianhydride, bis(3,4-dicarboxyphenyl)methane dianhydride, 1,1-bis(2,3-dicarboxyphenyl)ethane dianhydride, 1,1-bis(3,4-dicarboxyphenyl)ethane dianhydride, 2,2-bis[3,4-(dicarboxy-phenoxy)phenyl]propane dianhydride (BPADA), 4,4'-(hexafluoro-isopropylidene)diphthalic anhydride, oxydiphthalic anhydride (ODPA), bis(3,4-dicarboxyphenyl)sulfoxide dianhydride, thiodiphthalic dianhydride, perylene-3,4,9,10-tetracarboxylic dianhydride, anthracene-2,3,6,7-tetracarboxylic dianhydride, phenanthrene-1,2,7,8-tetracarboxylic dianhydride, 9,9-bis(3,4-dicarboxyphenyl) fluorene dianhydride and 9,9-bis[4-(3,4'-dicarboxyphenoxy) phenyl]fluorene dianhydride. Among these, pyromellitic dianhydride (PMDA), biphenyl-3,3',4,4'-tetracarboxylic dianhydride (BPDA), benzophenone-3,3',4,4'-tetracarboxylic dianhydride (BTDA), 2,2-bis[3,4-(dicarboxy-phenoxy) phenyl]propane dianhydride (BPADA) and oxydiphthalic anhydride (ODPA) are preferred.

These compounds may be used either singly or in any combination thereof.

The amount, of the aromatic tetracarboxylic acid used is preferably 0.85:1 to 1.2:1 in terms of a molar ratio of the aromatic tetracarboxylic acid:the aromatic diamine.

The polyamic acid preferably has a number average molecular weight of at least 1,000, more preferably 2,000 to 500,000, particularly preferably 5,000 to 150,000.

The number average molecular weight of the polyamic acid is measured by gel permeation chromatography (GPC) of a soluble matter in tetrahydrofuran (THF). Specifically, an apparatus "HLC-8220" (manufactured by Tosoh Corporation) and a column "TSKguard column+TSKgel Super HZM-M×3" (manufactured by Tosoh Corporation) are used, tetrahydrofuran (THF) as a carrier solvent is caused to flow at a flow rate of 0.2 ml/min while keeping a column temperature at 40° C., a sample to be measured is dissolved in tetrahydrofuran under dissolution conditions that a treatment is conducted, for 5 minutes at room temperature by means of an ultrasonic dispersing machine so as to give a concentration of 1 mg/ml, the resultant solution is then treated with a membrane filter having a pore size of 0.2 μm to obtain a sample solution, 10 μL of this sample solution is poured into the apparatus together with the carrier solvent to conduct detection by means of a refractive index detector (RI detector), thereby calculating out a molecular weight distribution of the sample to be measured by using a calibration curve measured by using monodisperse polystyrene standard particles. As standard polystyrene samples for measurement of the calibration curve were used those respectively having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, which were available from Pressure Chemical Co., to conduct measurement on at least about 10 standard polystyrene samples, thereby preparing the calibration curve. A refractive index detector was used, as an detector.

Aromatic Diamine:

No particular limitation is imposed on the aromatic diamine used in the synthesis of the polyamic acid. As examples thereof, may be mentioned para-phenylenediamine (PPD), meta-phenylenediamine (MPDA), 2,5'-diaminotoluene, 2,6-diaminotoluene, 4,4'-diaminobiphenyl, 3,3'-dimethyl-4,4'-diaminobiphenyl, 3,3'-dimethoxy-4,4'-diaminobiphenyl, 2,2-bis(trifluoromethyl)-4,4'-diaminobiphenyl, 3,3'-diamino-diphenylmethane, 4,4'-diaminodiphenylmethane (MDA), 2,2-bis-(4-aminophenyl)propane, 3,3'-diaminodiphenyl sulfone (33DDS), 4,4'-diaminodiphenyl sulfone (44DDS), 3,3'-diaminodiphenyl sulfide, 4,4'-diaminodiphenyl sulfide, 3,3'-diaminodiphenyl ether, 3,4'-diaminodiphenyl ether (34ODA), 4,4'-diamino-diphenyl ether (ODA), 1,5-diaminonaphthalene, 4,4'-diamino-diphenyldiethylsilane, 4,4'-diaminodiphenylsilane, 4,4'-diaminodiphenylethylphosphine oxide, 1,3-bis(3-aminophenoxy)-benzene (133APB), 1,3-bis(4-aminophenoxy)benzene (134APB), 1,4-bis(4-aminophenoxy)benzene, bis[4-(3-aminophenoxy)phenyl]sulfone (BAPSM), bis[4-(4-aminophenoxy)phenyl]sulfone (BAPS), 2,2-bis[4-(4-aminophenoxy)phenyl]propane (BAPP), 2,2-bis(3-aminophenyl)-1,1,1,3,3,3-hexafluoropropane, 2,2-bis(4-aminophenyl)-1,1,1,3,3,3-hexafluoropropane and 9,9-bis(4-aminophenyl)fluorene. Among these, para-phenylenediamine (PPD), meta-phenylenediamine (MPDA), 4,4'-diaminodiphenylmethane (MDA), 3,3'-diaminodiphenyl sulfone (33DD3), 4,4'-diaminodiphenyl sulfone (44DDS), 3,4'-diaminodiphenyl ether (34ODA), 4,4'-diamino-diphenyl ether (ODA), 1,3-bis(3-aminophenoxy)-benzene (133APB), 1,3-bis(4-aminophenoxy)-benzene (134APB), bis[4-(3-aminophenoxy)phenyl]sulfone (BAPSM), bis[4-(4-aminophenoxy)phenyl]sulfone (BAPS) and 2,2-bis[4-(4-aminophenoxy)phenyl]propane (BAPP) are particularly preferred.

These compounds may be used either singly or in any combination thereof.

The polyamic acid dope liquid is prepared by dissolving or dispersing the conductive substance in the polyamic acid solution obtained in the above-described manner, optionally containing additives such as a conducting agent, a surfactant, a viscosity adjuster and a plasticizer and optionally adding a solvent for dilution to control the concentration and viscosity of the resulting liquid.

The amount of the whole solvent in the polyamic acid dope liquid is preferably 20 to 90% by mass, more preferably 40 to 70% by mass.

No particular limitation is imposed on the viscosity of the polyamic acid, dope liquid so far as a resistance heating layer 15 having a desired thickness is obtained. However, it is, for example, 10 cP to 10,000 cP.

As the additives such as the surfactant and viscosity adjuster, may be used the substances described in "Newest Polyimide-Foundation and Application" (edited by Japanese Academic Societies for Polyimide Research, NTS Inc.) and "Newest Polyimide Materials and Applied Technology" (supervised by Masaaki Kakimoto, CMC Publishing CO., LTD.).

When a conductive substance and/or additives, which are not dissolved in the polyamic acid dope liquid are contained, a means for achieving uniform dispersion in the polyamic acid dope liquid is preferably used. For example, mixing and dispersion using a publicly known mixer, such as mixing by a stirring blade, mixing by a static mixer, mixing by a single screw kneader or twin-screw kneader, mixing by a homogenizer or mixing by an ultrasonic dispersing machine, are preferred.

(2) Belt-Like Precursor-Forming Step:

This belt-like precursor-forming step is a step of applying the polyamic acid dope liquid on to the reinforcing layer 11 by, for example, a cast method, then evaporating and removing the solvent, thereby obtaining a belt-like body, and placing the metal mesh sheet which becomes the electrode 12 on this belt-like body in a state brought into surface contact with each other, thereby preparing a belt-like precursor.

As a method for applying the polyamic acid dope liquid onto the reinforcing layer 11, may be used thin film-forming means such as a bar coater, a doctor blade, a slide hopper, spray coating, spiral coating and T-die extrusion.

No particular limitation is imposed, on a drying temperature for evaporating the solvent so far as the temperature is lower than an imidation-starting temperature which will be described subsequently, and the solvent can be evaporated. For example, the temperature is 40 to 280° C., preferably 80 to 260° C., more preferably 120 to 240° C., particularly preferably 120 to 220° C.

It is only necessary to conduct the drying until the content of the solvent in the belt-like body after the drying is reduced to the extent suitable for forming the belt-like precursor.

The contact state of the metal mesh sheet which becomes the electrode 12 with the belt-like body is preferably such that at least one surface of the sheet comes into contact, and the other surface is completely exposed. However, both surfaces may be embedded to extend the lead wire 12*a* therefrom.

(3) Imidation Reaction Step:

This imidation reaction step is a step of baking the belt-like precursor for a predetermined period of time at the specific baking temperature to imidate the polyamic acid, thereby forming the resistance heating layer 15 formed of the polyimide resin, while bonding the electrode 12 to the resistance heating layer 15.

The specific baking temperature in the imidation reaction is an imidation-starting temperature and is generally at least 280° C., preferably 280 to 400° C., more preferably 300 to 380° C., particularly preferably 330 to 380° C.

The baking time is generally at least 10 minutes, preferably 30 to 240 minutes.

According to the heating fixing belt 10 described above, in which the resin forming the resistance heating layer 15 is the polyimide resin, both the polyamic acid forming the polyimide resin and the metal mess sheet are baked in a state that they have been brought into surface contact with each other, whereby evaporation of the solvent related to the polyamic acid and water formed with the imidation is not inhibited, so that a desired polyimide resin can be easily formed, and the electrode 12 can be formed at the same time as the step of forming the polyimide resin. Accordingly, the production process can be simplified, and a state that a mesh portion in the metal mesh sheet that is the electrode 12 has been impregnated with the polyimide resin is formed, so that firm adhesion between the metal mesh sheet and the resistance heating layer 15 is easily achieved.

Image Forming Apparatus:

The fixing device according to the present invention can be installed in image forming apparatus having publicly known various constructions and suitably utilized in particular in what is called a medium-speed machine that a fixing linear speed is about 200 mm/min.

Image-Supporting Medium:

As examples of the image-supporting medium P on which a toner image is fixed in an image forming method using the fixing device according to the present invention, may be mentioned plain paper including thin paper and cardboard, wood-free paper, coated printing paper such as art paper and coat paper, commercially available Japanese paper and postcard paper, plastic films for OHP, and cloth, however, not limited thereto.

The embodiments of the present invention have been specifically described above. However, embodiments of the present invention are not limited to the above embodiments, and various changes or modifications may be added thereto.

Figure 3:
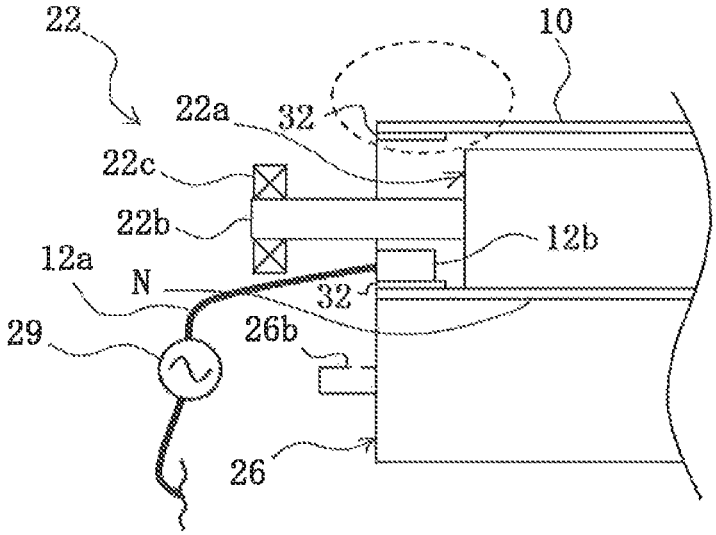
FIG. 3(*a*) is a longitudinal sectional view illustrating the construction of another exemplary fixing device equipped with a heating fixing belt according to the present invention, and FIG. 3(*b*) is an expanded view of a region surrounded by a dotted line in FIG. 3(*a*).
Figure 3:
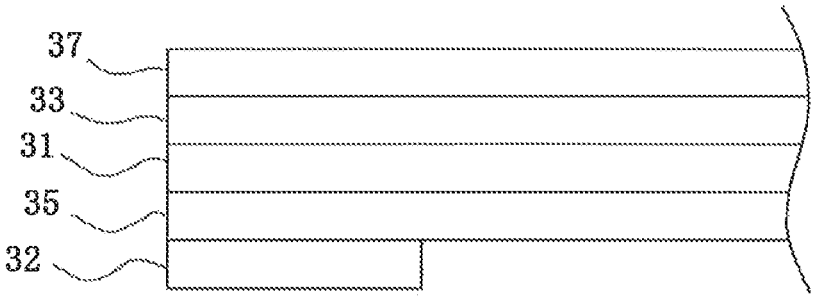

For example, the heating fixing belt according to the present invention may be so constructed that an elastic layer 33 is formed on an endless resistance heating layer 35 through a reinforcing layer 31, a parting layer 37 is further formed on the surface of this elastic layer 33, and an electrode 32 is bonded to a back surface of the resistance heating layer 35 in a state brought into surface contact with the resistance heating layer 35 as illustrated in FIG. 3(*b*). In this case, the fixing device is so constructed that the axial length of the pressure roller 26 is substantially the same as the axial length, of the heating fixing belt 10 to bring them into contact with each other over their overall lengths, and the axial length of the nip portion-forming roller 22*a* is shorter than the axial length of the pressure roller 26, and so only a region of the surface of the heating fixing belt 10, in which the nip portion-forming roller 22*a* has been brought into contact with the back surface thereof, is brought into contact under pressure with the pressure roller 26 as illustrated in FIG. 3(*a*). A pair of the electrodes 32 are respectively provided on both end portions of the back surface of the heating fixing belt 10, with which the nip portion-forming roller 22*a* does not come into contact, and these electrodes 32 are connected to the high-frequency power source 29 through the respective power supply members 12*b*.

Incidentally, other signs in FIG. 3 designate the same as those in FIG. 2.

In addition, a primer layer may be formed between, for example, the resistance heating layer 15 and the elastic layer 13 which make up the heating fixing belt 10 for the purpose of stabilizing the adhesion. The thickness of this primer layer is, for example, 2 to 5 μm.

EXAMPLES

Specific Examples of the present invention will hereinafter be described. However, the present invention is not limited thereto.

Examples 1 to 5

(1) Preparation of Polyamic Acid Dope Liquid

One hundred grams of polyamic acid "UJ-Varnish S301" (product of UBE INDUSTRIES, LTD.) and 18 g of graphite fiber "XN-100" (product of NIPPON GRAPHITE FIBER CORPORATION) as a conductive substance were sufficiently mixed by a mixer of a planetary system, thereby obtaining a polyamic acid dope liquid [1].

(2) Preparation of Reinforcing Layer, Resistance Heating Layer and Electrode After polyamic acid "U-Varnish S301" (product of UBE INDUSTRIES, LTD.) was applied, to a stainless steel tube having an outside diameter of 30 mm and an overall length of 345 mm so as to give a coating thickness of 500 μm, the coating was dried for 20 minutes at 120° C. to obtain a precursor of a reinforcing layer, and the polyamic acid dope liquid [1] obtained, above was applied on to this reinforcing layer so as to give a coating thickness of 500 μm and then dried for 3 hours at 150° C. to obtain a belt-like body. Metal mesh sheets made of a stainless steel and having aperture ratios of 10, 30, 60, 5 and 80, respectively, were separately wound on both end portions of the belt-like body to obtain belt-like precursors. These precursors were dried for 120 minutes at 320° C. under a nitrogen atmosphere to conduct imidation, thereby separately bonding the electrodes having the above-described aperture ratios to the resultant endless polyimide resin belts to prepare resistance heating structures [1] to [5].

(3) Preparation of Elastic Layer

After a primer "X331555" (product of Shin-Etsu Chemical Co., Ltd.) was applied to a region in each of the resistance heating structures [1] to [5] obtained above, to which no electrode was bonded, by brushing and dried for 30 minutes at ordinary temperature to form a primer layer, a composition obtained by mixing two liquids of liquid rubber of silicone rubber "KE1379" (product of Shin-Etsu. Chemical Co., Ltd.) and silicone rubber "DY356013" (product of Dow Corning Toray Silicone Co., Ltd.) at a ratio of 2:1 in advance was applied on to the primer layer so as to give a coating thickness of 200 μm and heated for 30 minutes at 150° C. to conduct primary vulcanization and then further heated for 4 hours at 200° C. to conduct post vulcanization, thereby preparing an elastic layer on the primer layer to form resistance heating-elastic layer structures [1] to [5]. The hardness of this elastic layer was 26°.

(4) Preparation of Parting Layer

After the surfaces of the elastic layers of the resistance heating-elastic layer structures [1] to [5] were cleaned, the resistance heating-elastic layer structures [1] to [5] were immersed for 3 minutes in a PTFE resin dispersion "30J" (product of Du Pont Co.) as a fluororesin (B) while being rotated and then taken out and dried for 20 minutes at ordinary temperature. The fluororesin on the surfaces of the elastic layers was then rubbed out with a fabric, the resistance heating-elastic layer structures [1] to [5] were further immersed in a PTFE resin dispersion "855-510" (product of Du Pont Co.) as a fluororesin (A), which was obtained by mixing a PTFE resin and a PFA resin at a ratio of 7:3 and adjusting its solid content concentration and viscosity to 45% and 110 mPa·s, respectively, thereby applying the dispersion so as to give a final coating thickness of 15 μm, and the thus-treated structures were dried for 30 minutes at room temperature and then heated for 30 minutes at 230° C. Thereafter, the structures were caused to pass through a tube furnace having an inside diameter of 100 mm, the furnace temperature of which was set to 270° C., in about 10 minutes to form a fluororesin layer by baking, and then cooled to form a parting layer on the elastic layer of each of the resistance heating-elastic layer structures [1] to [5], thereby obtaining heat fixing belts [1] to [5]. Thereafter, the heat fixing belts [1] to [5] were separated from the stainless steel tube.

Comparative Example 1

A heating fixing belt [6] was obtained in the same manner as in Example 1 except that no electrode was used.

Comparative Example 2

A heating fixing belt was obtained in the same as in Comparative Example 1, and conductive paste was applied, to both end portions of the resistance heating layer of this belt and heated and dried, for 1 hour at 190° C., thereby obtaining a heating fixing belt [7].

Comparative Example 3

A heating fixing belt was obtained in the same as in Comparative Example 1, and a metal tape was stuck on both end portions of the resistance heating layer of this belt with a conductive adhesive, thereby obtaining a heating fixing belt [3].

Evaluation of Performance:

The heating fixing belts [1] to [8] obtained above were evaluated as to long-term durability (life).

Specifically, one million prints with a gray solid image fixed thereto were formed by means of a modified machine with each of the heating fixing belts [1] to [8] obtained above used as a heating fixing belt in a medium-speed machine "bizhub C353" (manufactured by Konica Minolta Business Technologies, Inc.) to evaluate the heating fixing belt as to the life. Specifically, the heating fixing belt was ranked as "A" where the electrode was not separated up to the millionth fixing, and the same image as in an initial print could be formed on the print thereof, "B" where the electrode was not separated up to the millionth fixing, and some change was observed in the image of the print thereof compared with the initial print, but no practical problem was caused, or "C" where the electrode was separated, during the formation of one million prints, or electrical connection was unstable though no electrode was separated, and so the function of the electrode was not practically exhibited.

In addition, the image of the initial print was visually observed to evaluate the belt as to a fixed state. Specifically, the belt was ranked as "A" where no fixed portion was observed, "B" where an unfixed portion was partially observed, but no practical problem was caused, or "C" where many unfixed portions were observed, and the belt was not suitable for practical use.

TABLE 1

| | Heating fixing belt No. | Electrode | Aperture ratio | Evaluation results: Fixed state | Evaluation results: Life |
|---|---|---|---|---|---|
| Ex. 1 | [1] | Bonding of metal mesh sheet | 10 | A | A |
| Ex. 2 | [2] | Bonding of metal mesh sheet | 30 | A | A |
| Ex. 3 | [3] | Bonding of metal mesh sheet | 60 | A | A |
| Ex. 4 | [4] | Bonding of metal mesh sheet | 5 | A | B |
| Ex. 5 | [5] | Bonding of metal mesh sheet | 80 | B | B |
| Comp. Ex. 1 | [6] | Resistance heating layer was exposed as it is | — | C | C |
| Comp. Ex. 2 | [7] | Application of conductive paste | — | B | C |
| Comp. Ex. 3 | [8] | Sticking of metal tape | — | B | C |

REFERENCE SIGNS LIST

10 Heating fixing belt
11 Reinforcing layer
12 Electrode
**12*a*** Lead wire
**12*b*** Power supply member
13 Elastic layer
15 Resistance heating layer
17 Parting layer
20 Fixing device
22 Fixing rotator
**22*a*** Nip portion-forming roller

22*b* Shaft
22*c* Drive gear
26 Pressure roller
26*b* Shaft
29 High-frequency power source
31 Reinforcing layer
32 Electrode
33 Elastic layer
35 Resistance heating layer
37 Parting layer
N Nip portion
P Image-supporting medium

The invention claimed is:

1. A heating fixing belt comprising:

a resistance heating layer formed of a resin in which at least a conductive substance is dispersed is formed as an endless belt having two ends;

a parting layer laminated on the resistance heating layer; and a pair of metal mesh sheet electrodes for supplying electric power to the resistance heating layer, one of each of the pair of electrodes stacked on one of each of the endless belt and adhered to by impregnating the metal mesh sheet of the electrode with the resin of the resistance heating layer;

wherein the size of the electrode is 5 to 30 area % to the area of the resistance heating layer.

2. The heating fixing belt according to claim 1, wherein the metal mesh sheet forming the electrode has an aperture ratio of 10 to 60.

3. The heating fixing belt according to claim 1, wherein the resin forming the resistance heating layer is a polyimide resin.

4. The heating fixing belt according to claim 1, wherein the heating fixing belt further comprises an elastic layer laminated thereon.

5. The heating fixing belt according to claim 1, wherein the thickness of the electrode is 10 to 100 μm.

6. A fixing device comprising the heating fixing belt according to claim 1.

7. A process for forming the heating fixing belt which comprises:

forming an endless belt-like body from polyamic acid and a conductive substance;

placing a metal mesh sheet into surface contact with the belt-like body, and baking both the endless belt-like body and the metal mesh sheet to imidate the polyamic acid, thereby forming a polyimide resin and bonding the electrode to the resistance heating layer;

wherein the size of the electrode is 5 to 30 area % to the area of the resistance heating layer.

* * * * *